US006105236A

United States Patent [19]

Gallina et al.

[11] Patent Number: 6,105,236

[45] Date of Patent: Aug. 22, 2000

[54] MAGNETIC STRUCTURE FOR MINIMIZING AC RESISTANCE IN PLANAR RECTANGULAR CONDUCTORS

[75] Inventors: Jan S. Gallina, Torrance; Michael Brand, Los Angeles, both of Calif.

[73] Assignee: Raytheon Company, Lexington, Mass.

[21] Appl. No.: 09/019,326

[22] Filed: Feb. 5, 1998

[51] Int. Cl.[7] ..... H01F 7/06

[52] U.S. Cl. ..... 29/602.1; 29/603.13; 29/607; 29/608; 336/177

[58] Field of Search ..... 29/602.1, 600, 29/608, 605, 606, 603.13; 336/177; 428/138, 209, 901

[56] References Cited

U.S. PATENT DOCUMENTS

| | | | |
|---|---|---|---|
| Re. 29,476 | 11/1977 | Monforte et al. | 29/600 |
| 4,746,557 | 5/1988 | Sakamoto et al. | 428/138 |
| 4,998,339 | 3/1991 | Wiesner | 29/606 |
| 5,056,214 | 10/1991 | Holt | 29/602.1 |
| 5,070,594 | 12/1991 | Nagasaki et al. | 29/602.1 |
| 5,079,534 | 1/1992 | Steingroever et al. | 335/284 |
| 5,083,359 | 1/1992 | Aminder et al. | 29/602.1 |
| 5,287,479 | 2/1994 | Masaru et al. | 323/359 |
| 5,307,042 | 4/1994 | Papa, Jr. | 336/84 C |
| 5,551,146 | 9/1996 | Kawabata et al. | 29/608 |
| 5,706,572 | 1/1998 | Garshelis | 29/602.1 |
| 5,745,981 | 5/1998 | Roshen et al. | 29/607 |

*Primary Examiner*—Jessica J. Harrison
*Assistant Examiner*—Binh-An Nguyen
*Attorney, Agent, or Firm*—Leonard A. Alkov; Glenn H. Lenzen, Jr.

[57] ABSTRACT

Conductive apparatus having minimized AC resistance. The conductive apparatus comprises a planar rectangular conductor having top and bottom surfaces, and opposed end surfaces that are smaller in dimension than the top and bottom surfaces. Magnetic material is disposed adjacent to each of the end surfaces of the rectangular conductor that is formed in a "C" shape to provide end caps that are symmetrical and enclose the end surfaces and portions of the top and bottom surfaces to overlap the conductor in its corners. A method of fabricating the conductive apparatus is also disclosed.

2 Claims, 1 Drawing Sheet

MAGNETIC STRUCTURE FOR MINIMIZING AC RESISTANCE IN PLANAR RECTANGULAR CONDUCTORS

BACKGROUND

The present invention relates generally to planar rectangular conductors, and more particularly, to magnetic structure and method for minimizing AC resistance in planar rectangular conductors.

One current approach for minimizing AC resistance in planar rectangular conductors requires increasing the cross-section of the conductor. This approach is undesirable for high power density applications in which component volume is critical. Also, such rectangular conductors have thickness that unnecessarily increase fabrication costs.

Accordingly, it is an objective of the present invention to provide for magnetic structure and method for minimizing AC resistance in planar rectangular conductors.

SUMMARY OF THE INVENTION

To accomplish the above and other objectives, the present invention provides for a novel approach to reducing the AC resistance of a conductor having a rectangular cross-section. This is accomplished by strategically placing magnetic material of a specific shape adjacent to the conductor. Unlike conventional uses of magnetic materials in which a magnetic core is used to improve flux linkage and increase inductance, the approach of the present invention uses the magnetic material to minimize the flux density at specific locations within the conductor. Since current accumulates where the magnetic field density is greatest, minimizing the magnetic field results in a decrease in the localized current density and, thus, reduces the conductor resistance. The present invention provides for the use of specific magnetic material sizes, shapes, and symmetry rules which must be followed in order to minimize the conductor AC resistance.

Optimization of magnetic material location and geometry adjacent to the conductor can accomplish the same results for minimizing AC resistance without increasing the conductor cross-section. Further, the present invention allows the conductor thickness to be reduced, achieving a greater than 15% reduction in AC resistance over the thicker conductor with no magnetic material. A reduction in the conductor thickness leads to a reduction in cost and fabrication cycle time.

The present invention minimizes the AC resistance of planar conductors which have or approximate a rectangular cross-section. By minimizing AC resistance, the power dissipation in the conductor is minimized and, thus, the conductor Q is maximized. This result offers new opportunities for developing higher current, higher power printed networks, components (e.g., inductors) and circuits (e.g., RF amplifiers and VHF converters). It is believed that the present invention will reduce AC resistance and, consequently, AC losses by over 33%.

The present invention may be used in the fabrication of VHF converters. The present invention enables use of the VHF converter in the high current/low voltage converter market. Systems that require very high power processing densities will benefit from the present invention. In particular, active arrays will benefit from the reduced size, weight, and cost of rectangular conductors used therein, which will result from applying this technology to its antenna power supply subsystem. Other military applications for this technology include processors and manportable systems. There are also uses for this technology in the telecommunications, computer, and automotive applications. Applications for automobiles include power supplies for instrument clusters, radios, and microprocessors.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

By way of introductions, an electrical conductor carrying current at high frequencies experiences the well-known phenomenon known as skin effect. This effect, which is due to the generation of circulating currents within the conductor, causes the electrical current passing through the conductor to be concentrated near the surface, or skin, of the conductor. With a wire of circular cross-section, the current is evenly distributed, with maximum current density around the perimeter of the conductor. This uniform current distribution at the surface of the conductor is a direct result of the smooth (no corners), symmetrical geometry of the circular wire cross-section.

Figure 1:
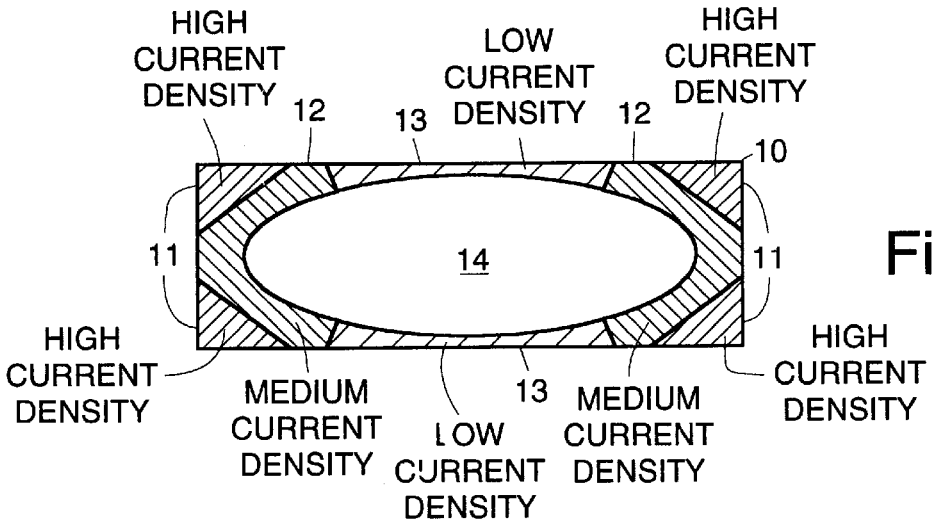
FIG. 1 is a cross-sectional view of the current distribution of a conventional rectangular conductor without end caps.
Figure 2:
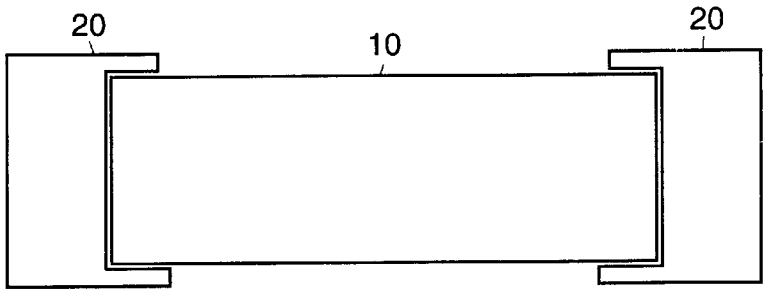
FIG. 2 is a cross-sectional view of a rectangular conductor having end caps in accordance with the principles of the present invention and whose AC resistance is minimized.

In general, electrical conductors found on circuit boards have, for the most part, a rectangular cross-section. Referring to the drawing figures, FIG. 1 is a cross-sectional view of the current distribution of a conventional rectangular conductor 10 without end caps 20 (FIG. 2). The rectangular cross-section of the rectangular conductor 10 is not a smooth surface due to the presence of corners 11. As a result, the magnetic field within the conductor 10 is not uniform, but is greatest in and near the corners 11 and least on the long flat top and bottom surfaces 13. A medium amount of current is carried in areas of the conductor 10 between the corners 11 and a central portion of the top and bottom surfaces 13, identified with reference numeral 12. The central portion of the top and bottom surfaces 13 carries very little current. The greatest concentration of current is, therefore, constrained to the corners 11, with the remainder of the conductor 10 carrying little, if any, current. There is negligible current in the center portion (unshaded area) of the conductor 10, identified by reference numeral 14. This is specifically illustrated in FIG. 1.

The redistribution of current over the rectangular cross-section of the conductor 10 that is associated with skin effect causes the AC resistance to increase because portions of the conductor 10 are not fully effective in carrying current. The increase in AC resistance results in a decrease in Q, which significantly degrades electrical performance.

To eliminate the problems associated with such a conventional rectangular conductor 10, the present invention provides for a unique design approach using magnetic material to minimize the AC resistance in such rectangular conductor 10. This is illustrated in FIG. 2. Using the approach of the present invention, magnetic material of a specific geometry is strategically placed adjacent to the conductor 10. The size, shape, and symmetry of the magnetic material are crucial design considerations which can be optimized for achieving minimum resistance.

As shown in FIG. 2, the magnetic material 20 is placed at each end of the short sides of the rectangular cross-section of the conductor 10. The magnetic material 20 on each end is formed in a "C" shape, is hereafter referred to as an end cap 20. The shape of the magnetic material 20 is important, in that the end caps 20 must be symmetrical and must overlap the conductor 10 in areas with the highest current density, i.e., in the corners 11. Other shapes and configurations, such as magnetic flanges along top and bottom sides of the conductor 10 or end caps 20 with no conductor overlap or a magnetic ring that encompasses the conductor 10, do not work. The size (dimensions) of the end caps 20 varies with the cross-section dimensions of the conductor 10. With magnetic end caps 20 of an optimized dimension, the high current density normally seen at the corners 11 of the conductor 10 redistributes toward the center 14 of the conductor 10 (within the skin depth), thus reducing the AC resistance. This is illustrated in FIG. 3, which is a cross-sectional view of the current distribution of the rectangular conductor 10 of FIG. 2 whose AC resistance is minimized using the present invention.

Figure 3:
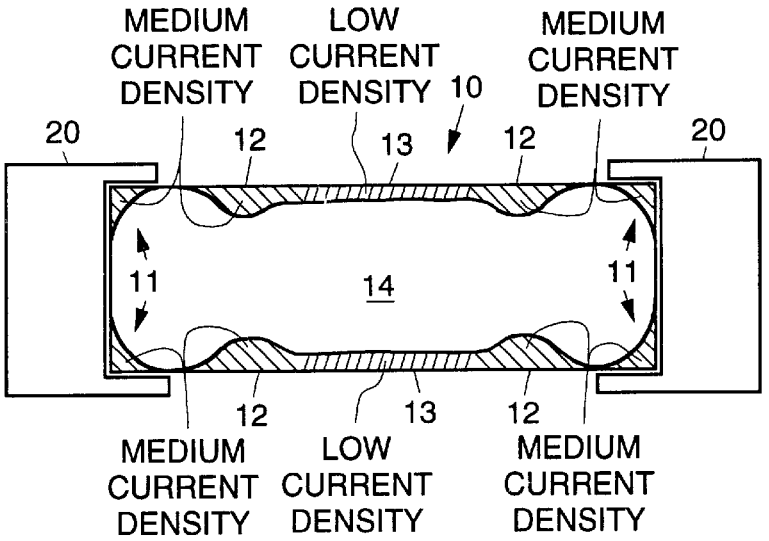
FIG. 3 is a cross-sectional view of the current distribution of the rectangular conductor of FIG. 2 whose AC resistance is minimized using the present invention.

As is shown in FIG. 3, the current density at the corners 11, and the portion of the top and bottom surfaces 13 outside its central portion contain a medium amount of current. The central portion of the top and bottom surfaces 13 carries very little current. There is negligible current in the center portion (unshaded area) of the conductor 10 laterally to the end caps 20, identified by reference numeral 14. This is specifically illustrated in FIG. 3.

Use of the present invention results in fabrication of improved VHF power supplies. Electromagnetic simulation software has proven to be an accurate means for evaluating the concept on which this invention is based. For example, 30 MHz results for a single rectangular cross-section conductor 10 which is 4 mils thick by 80 mils wide are shown in Table 1. Similar results for a single rectangular cross-section conductor 10 which is 1 mil thick by 80 mils wide are also shown in Table 1. The data indicates a 30 to 35% decrease in AC resistance per unit length with the implementation of end caps 20. Furthermore, the data shows that a 16% decrease in AC resistance per unit length can be achieved between the 4×80 conductor 10 with no end caps 20 and the 1×80 conductor 10 with end caps 20. This allows us the capability to fabricate lower profile, smaller parts while actually improving (i.e., reducing) AC resistance.

TABLE 1

| Conductor | Resistance (Ohm/Meter) | |
|---|---|---|
| Cross-section (mils) | Without End Caps | With End Caps ($\mu r$ = 6) |
| 4 × 80 | .559 | .391 |
| 1 × 80 | .724 | .469 |

Thus, a magnetic structure and method that minimizes AC resistance in planar rectangular conductors has been disclosed. It is to be understood that the described embodiments are merely illustrative of some of the many specific embodiments that represent applications of the principles of the present invention. Clearly, numerous and other arrangements can be readily devised by those skilled in the art without departing from the scope of the invention.

What is claimed is:

1. A conductive device having minimized AC resistance comprising:

a planar rectangular conductor having top and bottom surfaces, and opposed end surfaces that are smaller in dimension than the top and bottom surfaces; and magnetic material disposed adjacent to each of the end surfaces of the rectangular conductor that is formed in a "C" shape to provide two end caps that are symmetrical and enclose the end surfaces and portions of the top and bottom surfaces to overlap the conductor in its corners.

2. A method fabricating a planar rectangular conductor having minimized AC resistance, said method comprising the steps of:

providing a planar rectangular conductor having top and bottom surfaces, and opposed end surfaces that are smaller in dimension than the top and bottom surfaces; and disposing magnetic material adjacent to each of the end surfaces of the rectangular conductor in a "C" shape to form two end caps that are symmetrical and enclose the end surfaces and portions of the top and bottom surfaces to overlap the conductor in its corners.

* * * * *